US007712608B2

(12) United States Patent
Leach

(10) Patent No.: US 7,712,608 B2
(45) Date of Patent: May 11, 2010

(54) PROTECTIVE FOLDING CASE FOR GUITAR

(75) Inventor: Harvey Leach, Cedar Ridge, CA (US)

(73) Assignee: Voyage-Air Guitar, Inc., Livermore, CA (US)

( * ) Notice: Subject to any disclaimer, the term of this patent is extended or adjusted under 35 U.S.C. 154(b) by 162 days.

(21) Appl. No.: 11/958,347

(22) Filed: Dec. 17, 2007

(65) Prior Publication Data

US 2009/0152143 A1 Jun. 18, 2009

(51) Int. Cl.
*A45C 11/00* (2006.01)
*A45C 3/00* (2006.01)
*A45C 7/00* (2006.01)

(52) U.S. Cl. ..... 206/314; 190/107; 190/112

(58) Field of Classification Search ..... 206/14, 206/314; 190/112, 107
See application file for complete search history.

(56) References Cited

U.S. PATENT DOCUMENTS

| | | | | |
|---|---|---|---|---|
| 5,219,075 | A * | 6/1993 | White | 206/314 |
| 5,833,051 | A * | 11/1998 | Tiefenbrun et al. | 206/14 |
| 6,505,762 | B2 * | 1/2003 | Wilfer | 206/314 |
| 6,910,560 | B2 * | 6/2005 | Dulin | 190/112 |
| 2008/0060956 | A1 * | 3/2008 | Izen et al. | 206/314 |

* cited by examiner

*Primary Examiner*—Bryon P Gehman
(74) *Attorney, Agent, or Firm*—Thompson Hine LLP; Anthony H. Handal

(57) ABSTRACT

A guitar case comprises a guitar body receiving case portion, a guitar body portion cover and a neck portion case top. A neck portion case bottom and a neck portion case sidewall off further provided. A top neck zipper portion secures the neck portion case top to the neck portion case sidewall. A bottom neck zipper portion secures the neck portion case bottom to the neck portion case sidewall. A zipper portion secures the guitar body portion cover to the guitar body receiving case portion.

5 Claims, 5 Drawing Sheets

PROTECTIVE FOLDING CASE FOR GUITAR

TECHNICAL FIELD

The invention relates to cases for folding guitars.

BACKGROUND OF THE INVENTION

Today, it also low ever before. Accordingly, they are engaged at a relatively great amount of travel. Many individuals enjoy playing the guitar and often travel with their guitar.

However, a guitar is a relatively large instrument and traveling with a full-size guitar is not often practical. Accordingly, folding guitars have been developed for the purpose of providing an instrument which may be easily move from one place to another, whether by car, train or aircraft.

Stringed instruments have been known since ancient times. These included such instruments as the lute, a guitar-like instrument with a sound box and fingerboard. A New Kingdom (ancient Egypt, 1380 BC) bronze in the collection of the Metropolitan Museum of Art depicts a dancing Nubian raised on his toes with one knee cocked, left hand high working a fingerboard and right hand plucking the strings in a pose which might be illustrative of a modern rock musician.

But the lute has a much more ancient history, perhaps originating with West Semitic nomadic people who brought the instrument to Mesopotamia, where the archaeological record includes representations dating back to the Akkadian period (2350 to 2170 B.C.), being introduced to the Egyptians, perhaps at the end of the Middle Kingdom Hyksos dynasties (XV to XVII dynasty, 1730 to 1580 B.C.).

In more recent times, stringed lute-like musical instruments continue to be among the most popular instruments. Folk artists throughout the United States have used the guitar, sometimes one of the homemade variety, in a wide range of musical genres including blues, bluegrass, and so forth.

In contrast to percussive instrumentation, the need for amplification of the relatively weak sounds of strings, reeds, and vibrating human lips presented challenges to early musical instrument manufacturers. These challenges were met primarily by resonant systems that mechanically concentrate, and output musical sound. There is a demanding standard in the stability of the instrument if high-quality sound is to be produced.

Moreover, over the years, artists playing acoustic stringed instruments have introduced a wide variety of playing techniques into the music surrounding these instruments. While, perhaps, the ancients only plucked the strings of the lute to achieve a musical tone which gradually decayed, later artists used the bow to produce notes of relatively constant and somewhat controllable amplitude. Modern artists employ a variety of techniques in their performances. Acoustic blues performers may rap their instruments with fingertips, palms or knuckles. Certain violin compositions, typically played by having a horsehair bundle slide across the strings, also call for the strings to be plucked. This results in yet greater demands being put on the mechanical stability of the instrument.

Given the popularity of stringed musical instruments, especially the guitar, people often take them along when traveling. However, they are bulky and poorly suited to convenient transport. They are unlikely to fit into airlines stowaway spaces or under airline seats. In response to this need, guitars with folding necks have been proposed. See for example my earlier U.S. Design Pat. No. 516,114, and my earlier pending U.S. patent application Ser. No. 11/640,095, filed Dec. 15, 2006. While this instrument is effective, it is difficult to make requiring significant handwork and fine tuning.

Accordingly, there is a need for a stringed instrument which may be a guitar, violin or the like and which is easy to use during a performance, consistent, and rigorous in its transduction of artistic interpretations into an acoustic or other performance and easily transportable. It is believed that the structure disclosed herein is a most effective solution in providing for a highly mobile instrument which may be accommodated to a range of user preferences.

SUMMARY OF THE INVENTION

In accordance with the invention, a case which may accommodate a folding guitar, whether it is in the. told edition or any unfolded playing position is provided.

The inventive guitar case comprises a guitar body receiving case portion, a guitar body portion cover and a neck portion case top. A neck portion case bottom and a neck portion case sidewall off further provided. A top neck zipper portion secures the neck portion case top to the neck portion case sidewall. A bottom neck zipper portion secures the neck portion case bottom to the neck portion case sidewall. A zipper portion secures the guitar body portion cover to the guitar body receiving case portion.

BRIEF DESCRIPTION THE DRAWINGS

The operation of the invention will become apparent from the following description taken in conjunction with the drawings, in which.

Figure 9:
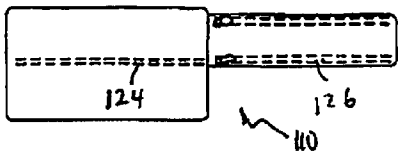
FIG. 9 is side view of an alternative embodiment of a guitar case according to the present invention.
Figure 10:
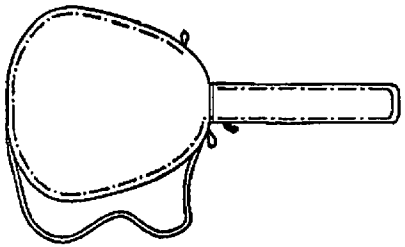
Figure 11:
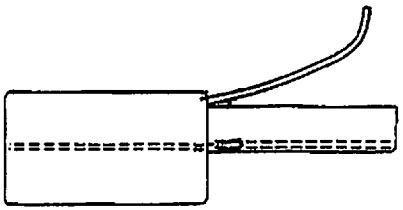
Figure 12:
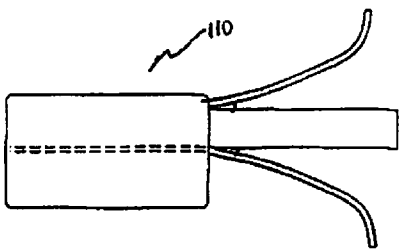
Figure 13:
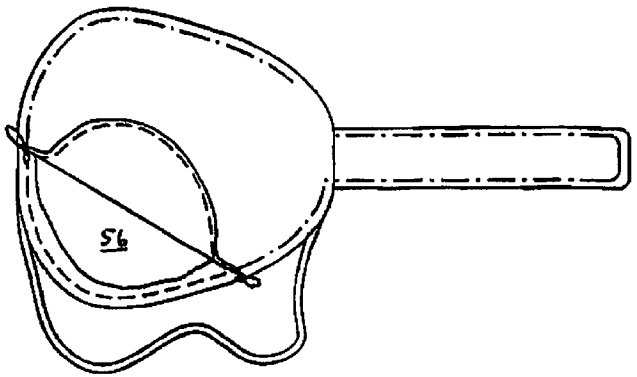
Figure 14:
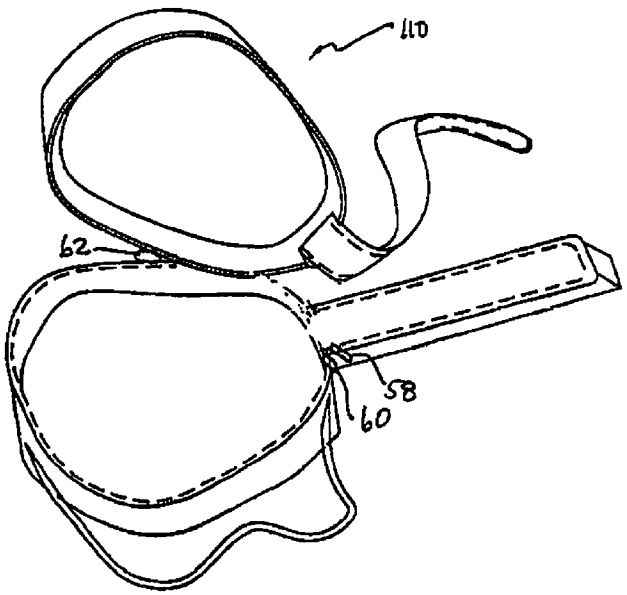

FIG. 10 a top plan view of the inventive guitar case illustrated in FIG. 9;

FIG. 11 is a side plan view illustrating the opening of the guitar case according to the present invention;

FIG. 12 illustrates a next step in the opening of the inventive guitar case;

FIG. 13 illustrates the opening of the top of the body retaking portion of the inventive guitar case;

FIG. 14 illustrates inventive guitar case in an open configuration; and

Figure 15:
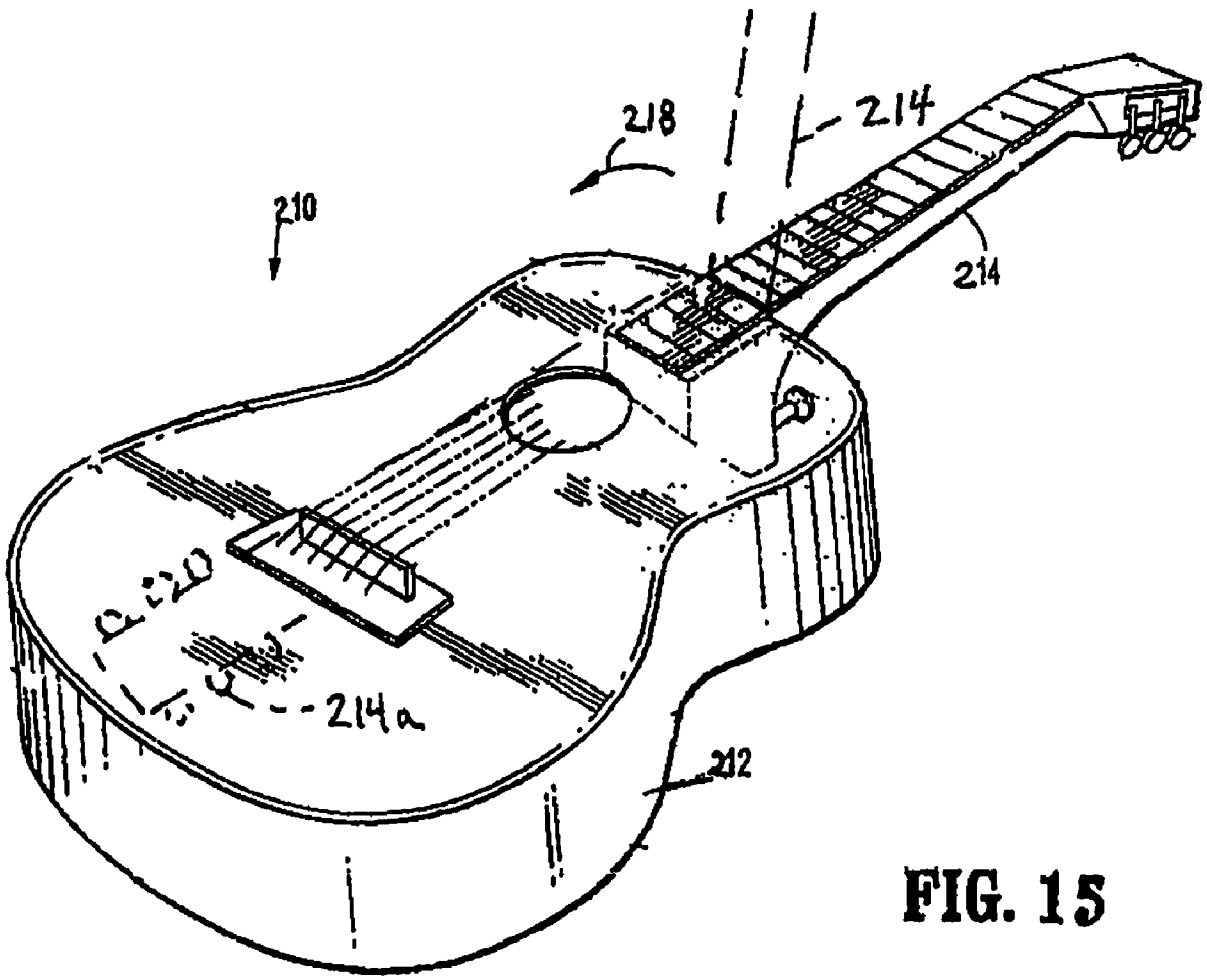

FIG. 15 illustrates a folding guitar with which the inventive guitar case may be used.

DETAILED DESCRIPTION OF THE PREFERRED EMBODIMENTS

Referring to a FIGS. 1-8, the inventive guitar case 10 comprises a main body portion top cover 12. Main body portion bottom 14 may be joined to top cover 12 by a zipper 16. A handle 18 is secured to bottom 14.

A neck top cover 20 is also secured by zipper 16. A neck bottom cover 22 it secured by a zipper 24. Guitar case 10 also includes a neck side portion 26.

Figure 8:
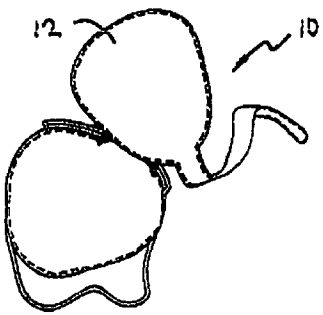
FIG. 8 illustrates the inventive guitar case in the open position with the upper neck protector unfurled for illustrative purposes.

If one desires to open the inventive case 10, neck top cover 20 is opened and engaged by grasping zipper pull 28 and advancing it to point 30. The zipper pull 32 is advanced to point 34. This allows the inventive guitar case to be put into a position with its top cover 12 open as illustrated in FIG. 8.

Figure 3:
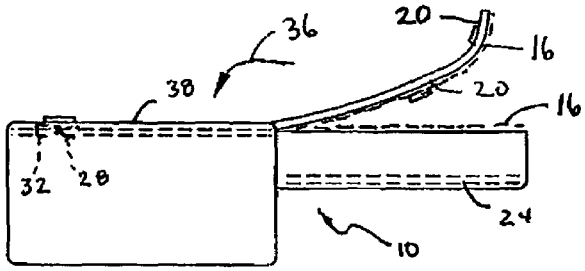
FIG. 3 is a view similar to FIG. 3 showing a first step in the opening of the inventive guitar case.
Figure 4:
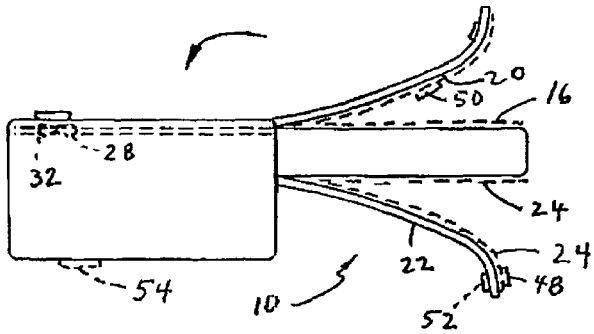
FIG. 4 shows another step in the opening of a guitar case in accordance with the present invention.
Figure 5:
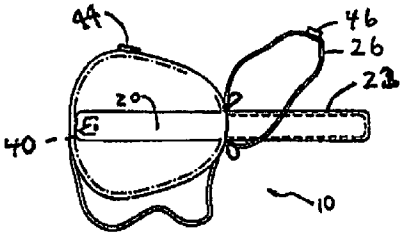
FIG. 5 illustrates another step in the opening of the inventive guitar case.

If desired, zipper pull 32 may be moved from the position illustrated in phantom lines an FIG. 3 to point 34. Similarly, pull 28 may be put at point 30. This allows neck top cover 20 to be raised as illustrated in FIG. 3. Top cover 20 may then be folded in the direction of arrow 36 to overlie the top face 38 of the guitar case and bring Velcro type hook connector 40 in contact and engagement with Velcro type loop connector 42 as illustrated in FIG. 5.

Figure 6:
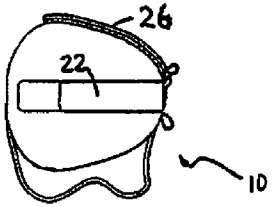
FIG. 6 illustrates the next step in the opening of the inventive guitar case.

In accordance with the preferred embodiment, zipper pulls 28 and 32 may be moved in either direction. In similar fashion, hook connector 44 may be brought into contact with loop connector 46 after zipper 24 has been opened, causing neck side portion 26 to lie flat as illustrated in FIG. 6. After neck side portion 26 has been put in the flat position illustrated in FIG. 6, neck bottom cover 22 may be caused to assume the position illustrated in FIG. 6 by engagement of hook material 48 with loop material 50. Alternatively, hook material 52 may be provided to engage loop material 54

Figure 7:
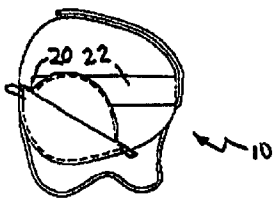
FIG. 7 illustrates a further step in the opening of the inventive guitar case.

By providing a separate zipper for neck top cover 20, the inventive guitar case 10 may be put in the configuration illustrated in FIG. 7.

Still yet another alternative embodiment of the inventive guitar case is illustrated in FIGS. 9-14. In this embodiment, guitar case 110 is provided with a central zipper or combination of zippers 124 and 126, which allow the inventive guitar case to take a number of configurations. For example, it may be completely closed and adapted to receive a conventional guitar or a folding guitar in the playing position as illustrated in FIGS. 9 and 10.

It may also be opened so that it may be put into a configuration suitable for a folded guitar by opening as illustrated in FIGS. 11 and 12 when a guitar 56 is contained within the case, it may be opened as illustrated in FIG. 13. Zipper pulls 58, 60 and 62 may be opened to cause case 110 to take the position illustrated in FIG. 14 allowing a guitar to be put in or removed from the case.

As illustrated in FIG. 15, a folding guitar 210 capable of having its neck 214 folded upwardly in the direction of arrow 218, as illustrated in phantom lines. Such action may be continued until the neck assumes the position illustrated at 214A in FIG. 15, and wedge neck 214A overlies guitar body 212.

Figure 1:
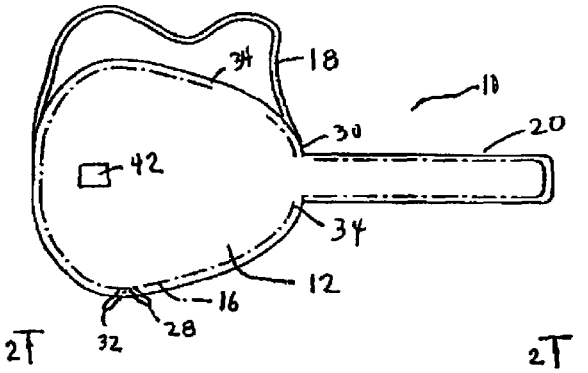
FIG. 1 is a top plan view of a guitar case constructed in accordance with the present invention.
Figure 2:
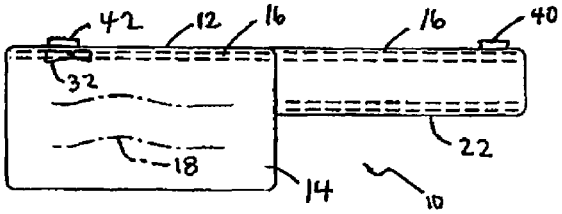
FIG. 2 is view along lines 2-2 of FIG. 1.

In accordance with the present invention, it is contemplated that a guitar in the position illustrated in solid lines in FIG. 15 may be placed in the inventive guitar case 10 when it is in the position illustrated in FIG. 1. Likewise, when in the playing position, a guitar will also fit into the inventive guitar case 110 illustrated in FIGS. 9 and 10.

When the guitar is fully folded, with its neck in the position illustrated at 214*a*, it fits into the guitar case when guitar case 10 is put in the position illustrated in FIG. 6. Likewise, such a folded guitar may be put into the case illustrated in FIGS. 9-14 by opening the neck zippers and folding back the neck top and bottom protectors and neck sidewall to positions analogous to those illustrated in FIG. 6, and secured through the use of hook and loop fasteners.

In accordance with the invention, it is contemplated that zippers in all embodiments may be zippers which operate in two directions, for added functionality.

What is claimed:

1. A guitar case, comprising:

(a) a guitar body receiving case portion having a side and a bottom;

(b) a guitar body portion cover;

(c) a neck portion case top;

(d) a neck portion case bottom;

(e) a neck portion case sidewall, configured as an elongated strip having a length and upper and lower elongated sides, each of said elongated sides extending along the length of said elongated strip;

(f) a top neck zipper portion extending along the upper elongated side of said neck portion case sidewall, said top neck zipper portion securing said neck portion case top to said neck portion case sidewall;

(g) a bottom neck zipper portion extending along the lower elongated side of said neck portion case sidewall, said bottom neck zipper portion securing said neck portion case bottom to said neck portion case sidewall, said neck portion case sidewall having an inside surface corresponding to the inside of said guitar case and an outside surface corresponding to the outside surface of said guitar case, said neck portion case sidewall being constructed to be folded over onto itself to define a substantially flat member when said top and bottom neck zipper portions are open, and said neck portion case top and said neck portion case bottom being constructed to be folded over the top and bottom of said guitar body receiving case portion, respectively; and (h) a zipper portion securing said guitar body portion cover to said guitar body receiving case portion.

2. A guitar case as in claim 1, further comprising:

(i) a first connector secured to said neck portion case top for securing said neck portion case top in a desired position;

(j) a second connector secured to said neck portion case bottom for securing said neck portion case bottom in a desired position; and (k) a third connector secured to said neck portion case sidewall for securing said neck portion case sidewall in a desired position.

3. A guitar case comprising:

(a) a guitar body receiving case portion having a side and a bottom;

(b) a guitar body portion cover;

(c) a neck portion case top;

(d) a neck portion case bottom;

(e) a neck portion case sidewall;

(f) a top neck zipper portion securing said neck portion case top to said neck portion case sidewall;

(g) a bottom neck zipper portion securing said neck portion case bottom to said neck portion case sidewall;

(h) a zipper portion securing said guitar body portion cover to said guitar body receiving case portion;

(i) a first connector secured to said neck portion case top for securing said neck portion case top in a desired position, said neck portion case top defining a substantially flat elongated member constructed to be folded over said guitar body portion cover;

(j) a second connector secured to said neck portion case bottom for securing said neck portion case bottom in a desired position, said neck portion case bottom defining a substantially flat elongated member constructed to be folded against the bottom of said guitar body receiving case portion; and (k) a third connector secured to said neck portion case sidewall for securing said neck portion case sidewall in a desired position folded against the side of said guitar body receiving case portion.

4. A guitar case as in claim 3, further comprising a carrying strap.

5. A guitar case as in claim 3, wherein said guitar body portion cover, the bottom of said guitar body receiving case portion and the side of said guitar body receiving case portion are provided with corresponding mating connectors to receive said first, second and third connectors.

* * * * *